US009458688B2

(12) United States Patent
Adkinson et al.

(10) Patent No.: US 9,458,688 B2
(45) Date of Patent: Oct. 4, 2016

(54) WELLHEAD SYSTEM FOR TIEBACK RETRIEVAL

(71) Applicant: GE Oil & Gas Pressure Control LP, Houston, TX (US)

(72) Inventors: Sheila Adkinson, Houston, TX (US); Saurabh Kajaria, Houston, TX (US); Khang Nguyen, Houston, TX (US); Knox Wright, Houston, TX (US)

(73) Assignee: GE Oil & Gas Pressure Control LP, Houston, TX (US)

( * ) Notice: Subject to any disclaimer, the term of this patent is extended or adjusted under 35 U.S.C. 154(b) by 360 days.

(21) Appl. No.: 14/085,255

(22) Filed: Nov. 20, 2013

(65) Prior Publication Data

US 2014/0238693 A1 Aug. 28, 2014

Related U.S. Application Data

(60) Provisional application No. 61/769,541, filed on Feb. 26, 2013.

(51) Int. Cl.

| | |
|---|---|
| ***E21B 33/03*** | (2006.01) |
| ***E21B 33/04*** | (2006.01) |
| ***E21B 33/068*** | (2006.01) |
| ***E21B 43/26*** | (2006.01) |

(52) U.S. Cl.

CPC ..... *E21B 33/03* (2013.01); *E21B 33/04* (2013.01); *E21B 33/068* (2013.01); *E21B 43/26* (2013.01)

(58) Field of Classification Search

CPC ..... E21B 33/03; E21B 33/04; E21B 33/047; E21B 33/068; E21B 43/26

See application file for complete search history.

(56) References Cited

U.S. PATENT DOCUMENTS

| | | | | |
|---|---|---|---|---|
| 4,076,079 | A | 2/1978 | Herricks et al. | |
| 7,490,666 | B2 | 2/2009 | Swagerty et al. | |
| 7,578,351 | B2 | 8/2009 | Dallas | |
| 7,823,634 | B2 | 11/2010 | Chan et al. | |
| 7,857,062 | B2 | 12/2010 | Dallas | |
| 2003/0051878 | A1* | 3/2003 | DeBerry | E21B 7/12 166/348 |
| 2007/0251702 | A1 | 11/2007 | Dallas et al. | |
| 2011/0155367 | A1 | 6/2011 | Swagerty et al. | |
| 2011/0180252 | A1 | 7/2011 | McGuire | |
| 2013/0014947 | A1 | 1/2013 | Wilkins et al. | |

OTHER PUBLICATIONS

PCT Search Report and Written Opinion issued Jun. 6, 2014 in connection with corresponding PCT Patent Application No. PCT/US2014/017624.

* cited by examiner

*Primary Examiner* — Brad Harcourt
(74) *Attorney, Agent, or Firm* — Bracewell LLP

(57) ABSTRACT

A wellhead assembly includes a casing head, tubing head, and a production tree mounted on the tubing head. An isolation sleeve is set in a main bore of the wellhead assembly that extends across an interface between the casing and tubing heads so that a portion resides in each. The isolation sleeve is configured so that a fracturing string, and its associated hanger, can be retrieved through the isolation sleeve; which significantly reduces the time and steps required to conduct a fracturing operation in a well. Moreover, the present isolation sleeve can be used without changes to existing casing or tubing heads.

13 Claims, 5 Drawing Sheets

WELLHEAD SYSTEM FOR TIEBACK RETRIEVAL

CROSS REFERENCE TO RELATED APPLICATION

This application claims priority to and the benefit of co-pending U.S. Provisional Application Ser. No. 61/769,541 filed Feb. 26, 2013 the full disclosure of which is hereby incorporated by reference herein for all purposes.

BACKGROUND

1. Field of Invention

The present disclosure relates in general to a wellhead assembly with an isolation sleeve through which a fracturing string with an associated hanger can be retrieved.

2. Description of Prior Art

Hydrocarbon producing wellbores are sometimes stimulated to increase the production of hydrocarbons. Hydraulic fracturing, or fracing, is one example of stimulation, which involves pressurizing all or a portion of the wellbore to improve communication between the surrounding formation and the wellbore. Generally, a fracturing fluid is pressurized at surface by a pump, which passes through a fracturing tree then enters a fracturing string. The fracturing string extends into the well and is supported by a string hanger in the wellhead. When the fracturing process is completed, a bridge plug is installed in the wellhead and the fracturing tree is replaced with a blowout preventer. A bored out tubing spool is utilized to allow full bore opening. The fracturing string and string hanger are retrieved through the blowout preventer. The blowout preventer and bored out tubing spool can then be removed and replaced with a standard tubing spool and a subsequent wellhead member, such as a tubing head. The bridge plug can be retrieved.

SUMMARY OF THE INVENTION

Embodiments of the system and method of this disclosure eliminate the steps of adding a bridge plug and blowout preventer to the casing head before retrieving the string hanger and fracturing string, as was previously required. The step of having to remove the bridge plug and blowout preventer after retrieving the string hanger and fracturing string are also eliminated. The need for a bored out spool is also eliminated.

Disclosed herein is an example of a wellhead assembly having a casing head mounted on a wellbore and a tubing head on the casing head. A main bore extends axially through the casing head and tubing head. A landing area in the main bore is profiled to selectively receive a fracturing string hanger. An annular isolation sleeve is coaxially set in the main bore. The isolation sleeve has an inner radius greater than an outer radius of the fracturing string hanger, so that the fracturing string hanger selectively passes through the isolation sleeve.

In an alternative embodiment, a wellhead assembly has a casing head mounted on a wellbore and a tubing head on the casing head. A main bore extends axially through the casing head and tubing head. An annular packoff assembly is disposed in the main bore, the annular packoff assembly having a landing area that is profiled to selectively receive a fracturing string hanger. An annular isolation sleeve is coaxially set in the main bore, a first portion of the annular isolation sleeve being located in the tubing head and a second portion of the annular isolation sleeve being located in the casing head. The annular isolation sleeve has an inner radius greater than an outer radius of the fracturing string hanger, so that the fracturing string hanger selectively passes through the isolation sleeve. An inner radius of the main bore of the tubing head is greater than an outer radius of the fracturing string hanger, so that the fracturing string hanger selectively passes through the tubing head.

In yet another alternative embodiment, a method for retrieving a fracturing string hanger from a wellhead assembly includes installing an annular isolation sleeve and tubing head on a casing head of a wellbore, the annular isolation sleeve having an inner radius greater than an outer radius of the fracturing string hanger. The fracturing string hanger is passed through the isolation sleeve.

BRIEF DESCRIPTION OF DRAWINGS

Some of the features and benefits of the present invention having been stated, others will become apparent as the description proceeds when taken in conjunction with the accompanying drawings, in which.

Figure 1:
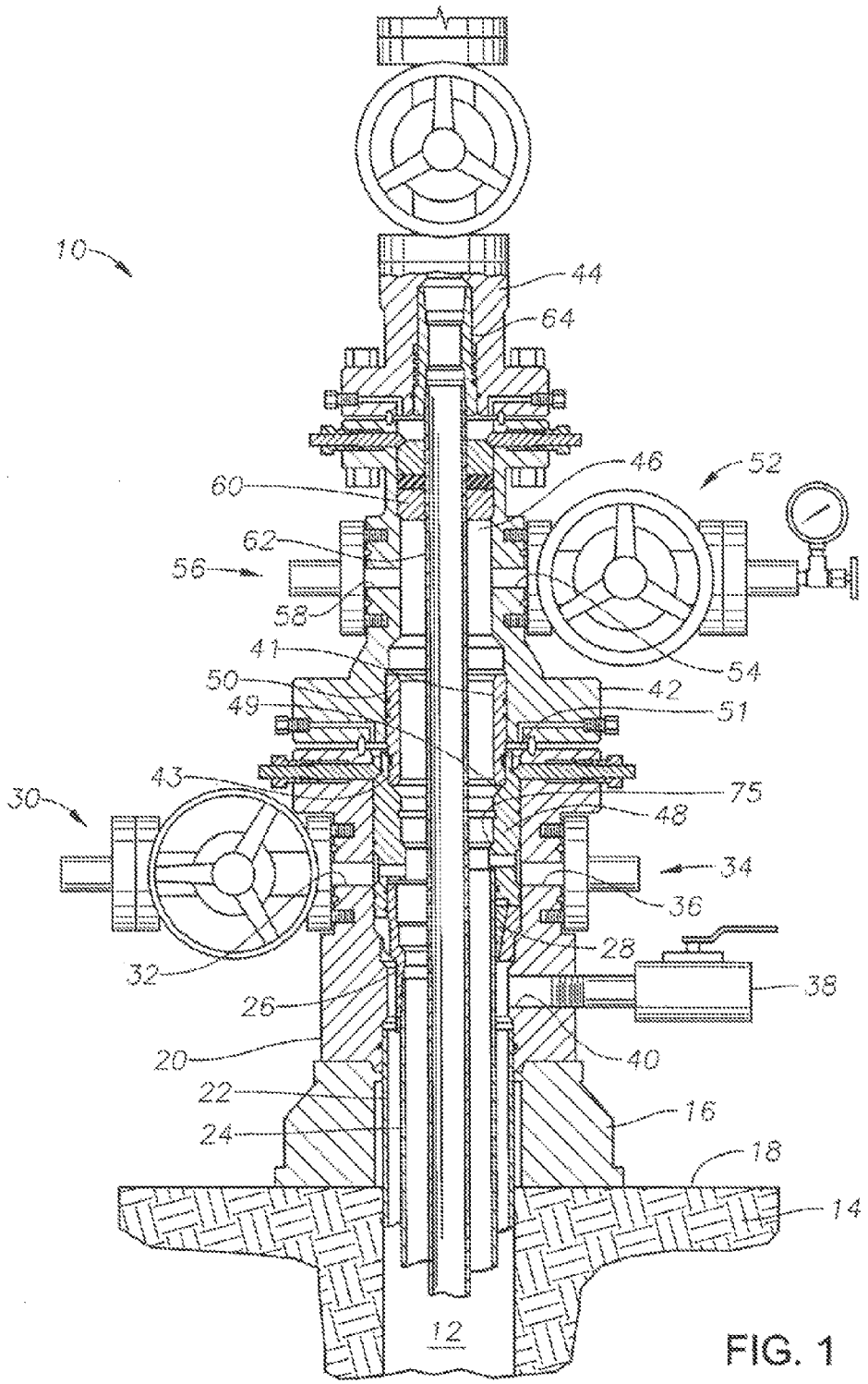
FIG. 1 is a side partial sectional view of an example embodiment of a wellhead assembly set over a wellbore and in accordance with the present invention.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

An example of a wellhead assembly 10 is shown in a side sectional view in FIG. 1, wherein the wellhead assembly 10 is mounted over a wellbore 12 that projects into a subterranean formation 14. A base plate 16 (wellhead housing) makes up a lower portion of the wellhead assembly 10, and sits on the surface 18 of the formation 14. An annular casing head 20 mounts on top of the base plate 16; from which a length of conductor casing 22 extends downward into wellbore 12. Inserted within conductor casing 22 is a string of intermediate casing 24 supported within casing head 20 on a casing hanger 26, which is shown landed within casing head 20. Optionally, an emergency casing hanger 28 (casing slip) is shown within casing head 20 and provides an alternative means of securing and supporting the intermediate casing 24. Valve 30 is shown mounted on a side wall of casing head 20 and provides selective communication between the area ambient to wellhead assembly 10 and the inside of casing head 20 via port 32. Similarly, a plug assembly 34 provides selective communication to the inside of casing head 20 via port 36. An additional valve 38 mounts into the side wall of the casing head 20 and communicates with inside of casing head 20 via port 40.

A flanged coupling sealingly engages an upper end of casing head 20 to an annular tubing head 42, creating an interface 51 between the upper end of casing head 20 and the annular tubing head 42. Similarly, a production tree 44 is flange mounted on an upper end of tubing head 42 that is distal from casing head 20. A main bore 46 axially intersects casing head 20 and tubing head 42.

An annular packoff assembly 48 is shown coaxially in the portion of main bore 46 that is within casing head 20. A transition on an inner surface of annular packoff assembly 48 is formed where its inner radius projects outward and defines a circular groove and a landing area or shoulder 49 on its upper end. A lower end of an annular isolation sleeve 50 (isolation bushing) is illustrated mated with and landed on shoulder 49. In an example, an inner radius of isolation sleeve 50 is at least as large as an inner radius of the annular packoff assembly 48 below shoulder 49. An inner radius of the main bore 46 of tubing head 42 above isolation sleeve 50 is sized at least as large as an inner radius of the annular packoff assembly 48 below shoulder 49. The inner radius of the main bore 46 of tubing head 42 is enlarged proximate to the casing head 20 and is as least as large as an outer radius of the isolation sleeve 50 to accommodate the annular isolation sleeve 50.

In the example of FIG. 1, isolation sleeve 50 intersects the interface 51 between casing head 20 and tubing head 42 so that opposing portions of isolation sleeve 50 are respectively circumscribed by tubing head 42 and casing head 20 so that a first portion 41 of isolation sleeve 50 is located within tubing head 42 and a second portion 43 of isolation sleeve 50 is located in casing head 20. Seals on an outer radius of isolation sleeve 50 provide sealing contact between isolation sleeve 50 and annular packoff assembly 48. Additionally, seals also create a fluid and pressure barrier between the outer radius of isolation sleeve 50 and inner radius of casing head 42. Thus the isolation sleeve 50 blocks communication between the main bore 46 and fluid lines shown formed through the side walls of casing head 20 and tubing head 42. Isolation sleeve 50 also seals the main bore 46 from the interface 51 of casing head 20 and tubing head 42.

Still referring to FIG. 1, a valve 52 shown registering with port 54 through a side wall of tubing head 42 provides selective communication to main bore 46 from outside wellhead assembly 10. Additionally, plug assembly 56 which registers with port 58 in a side wall of tubing head 42 allows for selective communication into main bore 46. Further shown in main bore 46 is a second annular packoff 60 that seals around a string of production tubing 62 shown coaxially within main bore 46 and extending downward into wellbore 12. In an example, production tubing 62 communicates wellbore fluids produced from within wellbore 12 to the production tree 44. A production tubing hanger 64 is shown mounted within production tree 44 and supports production string 62.

Figure 2:
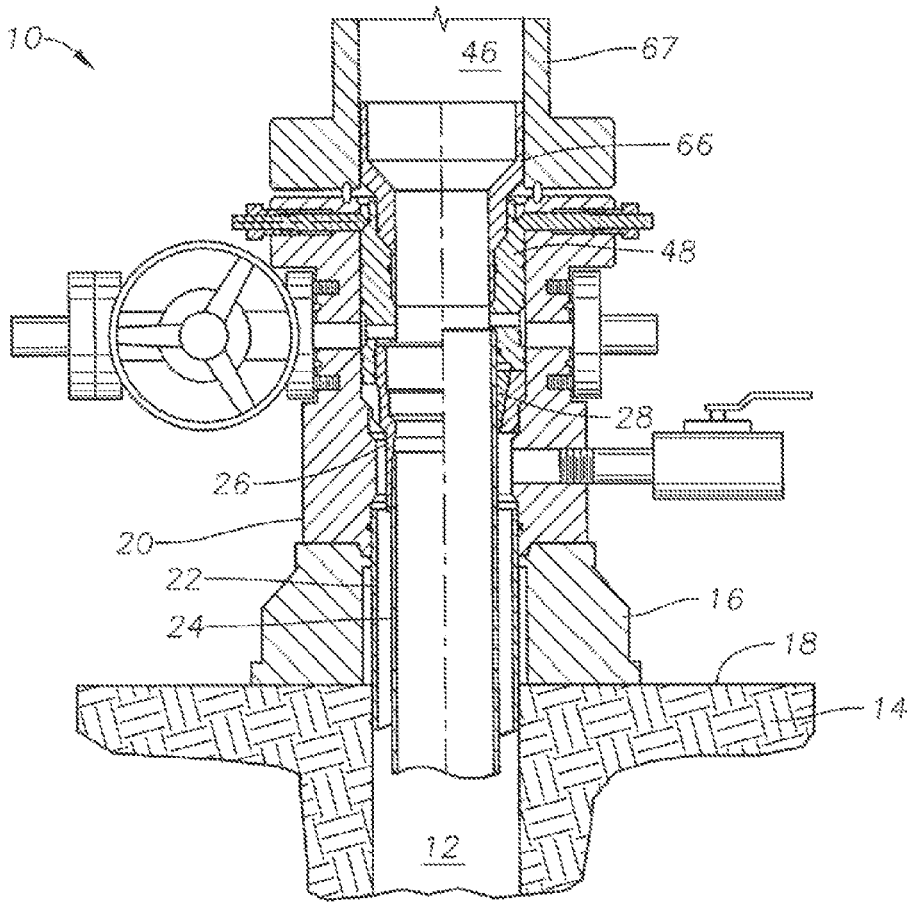
FIG. 2 is a side partial sectional view of a portion of the wellhead assembly of FIG. 1 configured for drilling the wellbore in accordance with the present invention.

The example of the wellhead assembly 10 of FIG. 1 is functional and produces fluids from the wellbore 12, wherein the wellbore 12 is completed. Referring now to the example of FIG. 2, the wellbore 12 is shown in a stage of being formed and prior to being completed. The wellhead assembly 10 of FIG. 2 includes an annular wear bushing 66 coaxially mounted within main bore 46 and landed on the annular packoff assembly 48. In this example, wear bushing 66 protects annular packoff assembly 48 from a drill string (not shown), that inserts through the main bore 46 and bores through the formation 14 to form the wellbore 12. A blowout preventer 67, which is shown coupled on an upper end of casing head 20 with a flange connection, can be used for pressure control of the wellbore 12. Further in the example of FIG. 2, an upper end of the wear bushing 66 is coaxially disposed within a portion of the main bore 46 in the blowout preventer 67, while its lower end is circumscribed by the annular packoff assembly 48, which is within casing head 20.

Figure 3:
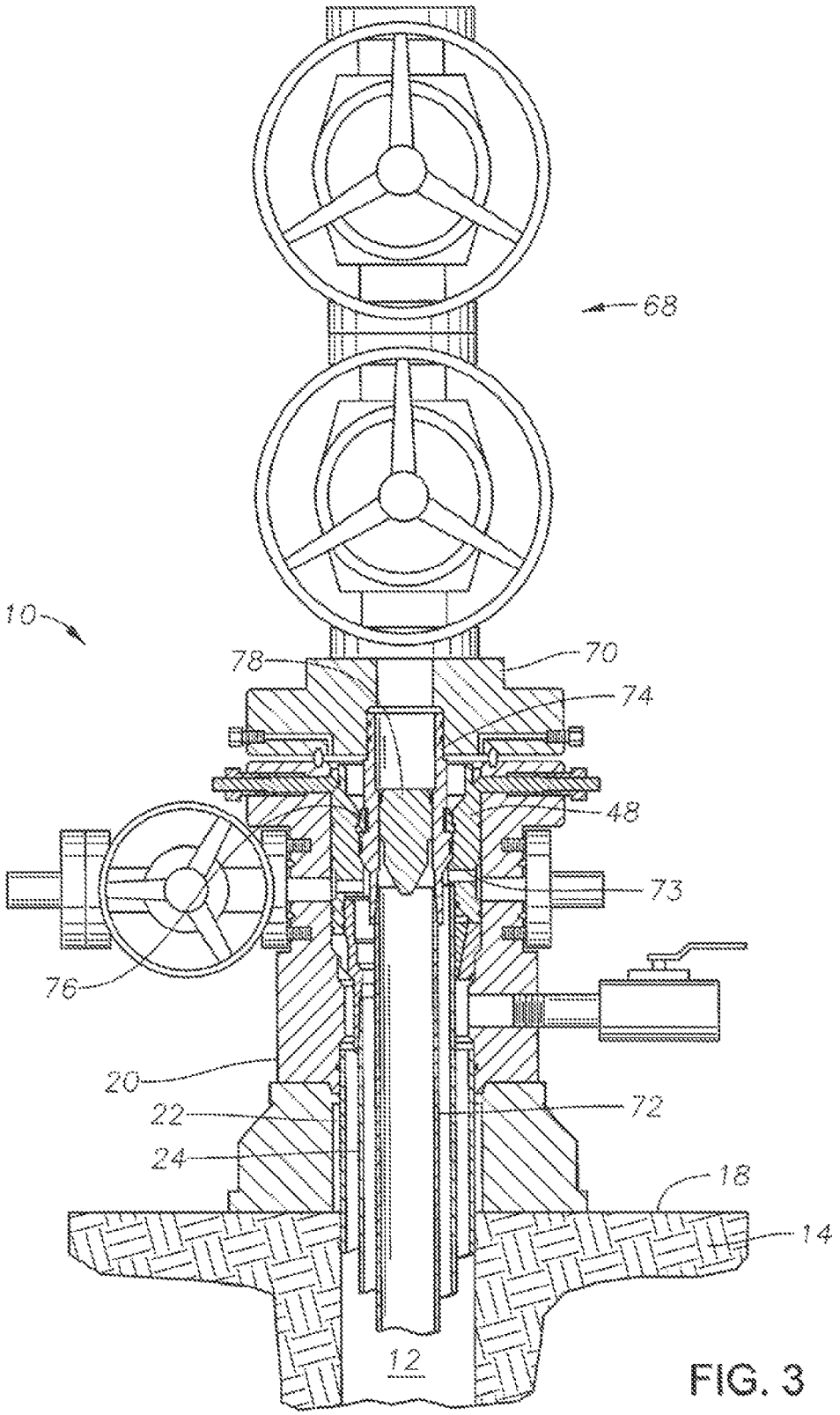
FIG. 3 is a side partial sectional view of the wellhead assembly of FIG. 1 with a fracturing tree and fracturing string in accordance with the present invention.
Figure 5:
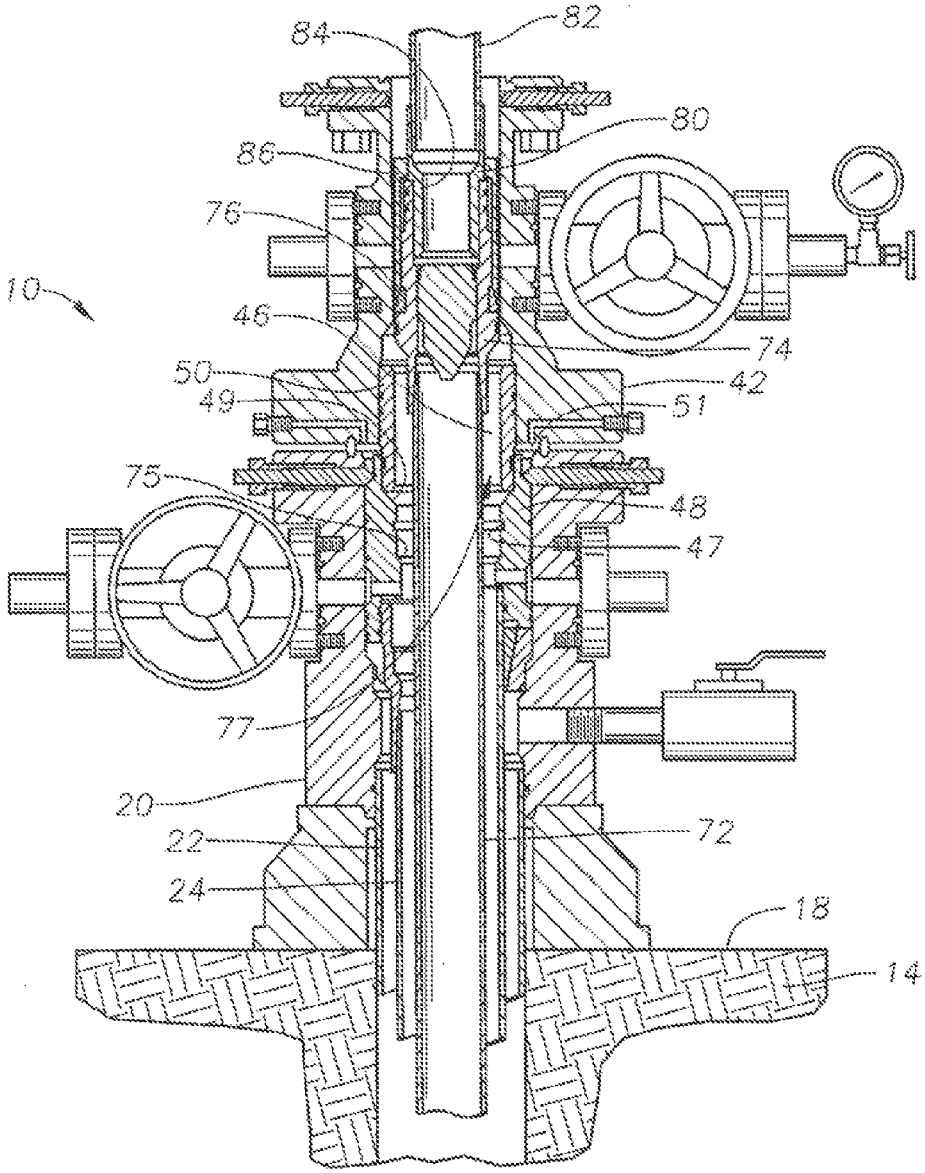
FIG. 5 is a side partial sectional view of an embodiment of the wellhead assembly of FIG. 4, with the fracturing string being removed and in accordance with the present invention.

FIG. 3 illustrates in a side partial sectional view an example of fracturing the formation 14 adjacent the wellbore 12. As shown, the blowout preventer 67 has been removed and replaced with a fracturing tree 68 coupled with the casing head 20. An optional tubing head adapter 70 attached to a lower end of fracturing tree 68 mounts onto casing head 20 with a flange connection, thus facilitating connectivity of fracturing tree 68 with casing head 20. Instead of production tubing 62 (FIG. 1), a tieback or tubular fracturing string 72 extends into wellbore 12 from fracturing tree 68 and through casing head 20. Supporting the fracturing string 72 is a string hanger 74 shown having an upper end coupled coaxially within tubing head adapter 70. In this example, the wear bushing 66 (FIG. 2) has been removed from within the annular packoff assembly 48 which allows a lock ring 76 of the string hanger 74 to selectively engage an inner profile 47 (FIG. 5) of the annular packoff assembly 48. An inner radius of the annular packoff assembly 48 is reduced at its lower end to form an upward facing or landing area or circular shelf 75 (FIG. 5). A sloped downward facing surface 73 of string hanger 74 engages circular shelf 75. In alternative embodiments, lock ring 76 may be omitted. An external radius of string hanger 74 is sized to fit within a portion of annular packoff assembly 48. Fracturing string 72 delivers fracturing fluids into the wellbore 12, which fracturing tree 68 controls a flow of the fracturing fluid to the fracturing string 72.

Referring back to FIG. 3, after fracturing operations are complete, a back pressure valve 78 can be inserted within fracturing string 72 thereby blocking communication from within wellbore 12 into above the back pressure valve 78. In this case, the back pressure valve 78, string hanger 74, and annular packoff assembly 48 are shown coaxially disposed within casing head 20. Isolating pressure within the wellbore 12 with the back pressure valve 78 allows removal of tubing head adapter 70 and fracturing tree 68.

Figure 4:
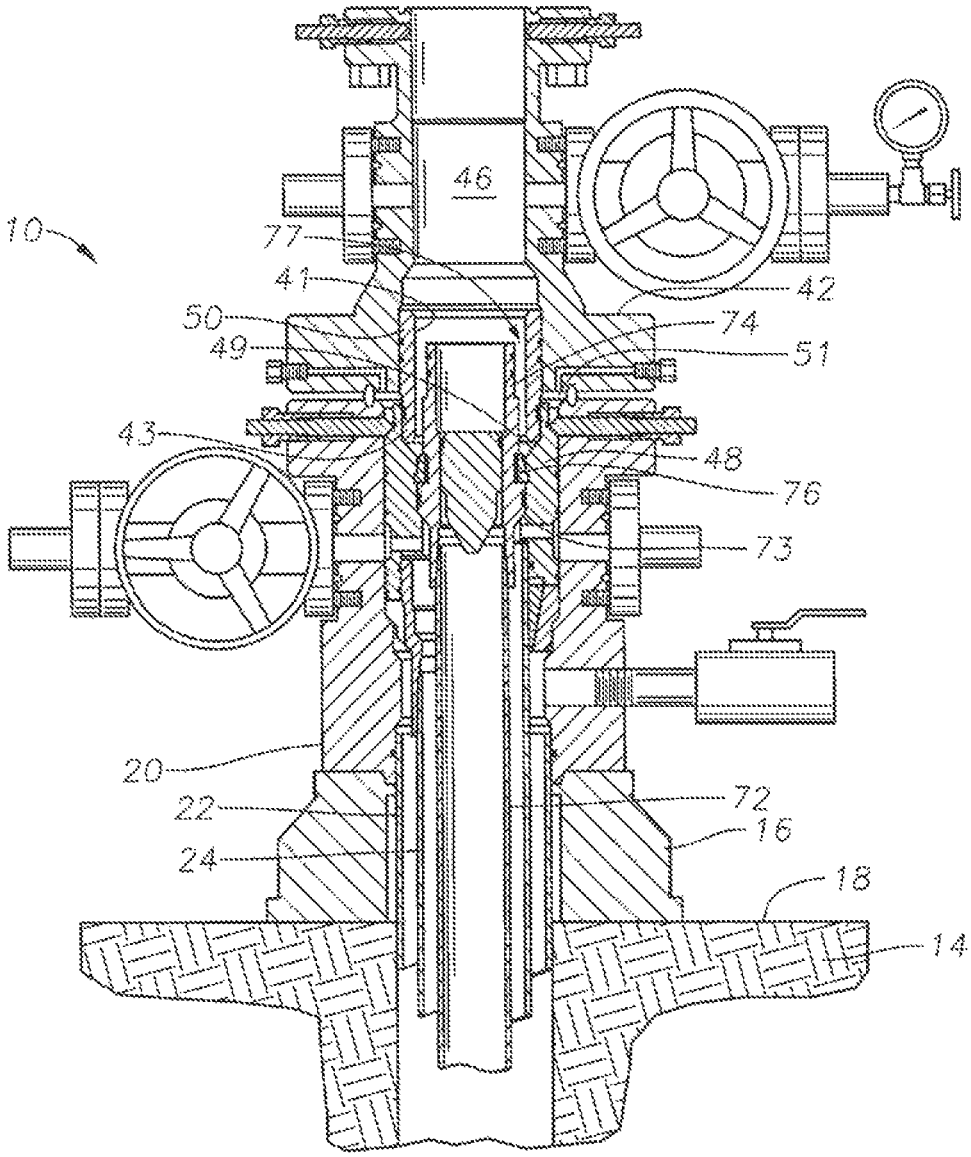
FIG. 4 is a side partial sectional view of an embodiment of the wellhead assembly of FIG. 3, having a tubing head in place of the fracturing tree and in accordance with the present invention.

As shown in FIG. 4, tubing head adapter 70 and fracturing tree 68 (FIG. 3) have been removed from the wellhead assembly 10. Instead of installing a bridge plug to casing head 20 and adding a blowout preventer to the upper end of casing head 20, embodiments of this disclosure allow for tubing head 42 and isolation sleeve 50 to now be installed on the upper end of casing head 20. Further in this example, the inner radius of isolation sleeve 50 exceeds the outer radius of the string hanger 74 and forms an annular gap 77 between these two members. This gap 77 allows for the required clearance for string hanger 74 and fracturing string 72 to be pulled out of casing head 20 and pass through tubing head 42. Because the inner radius of the isolation sleeve 50 and tubing head 42 above isolation sleeve 50 is at least as large as an inner radius of the annular packoff assembly 48 below shoulder 49, string hanger 74 and fracturing string 72 can pass through isolation sleeve 50 and tubing head 42. Thus string hanger 74 and fracturing string 72 can be retrieved from within wellhead assembly 10 without removing tubing head 42.

The example of FIG. 5 illustrates in partial side sectional view an example of removing the string hanger 74 from within the wellhead assembly 10 using a landing joint 80 that is coupled to a lower end of a pipe string 82 with a threaded connection. The landing joint 80 is an annular member with an inner sleeve 84 Inner sleeve 84 inserts within an upper end of string hanger 74 and engages threads formed on an inner radial surface of string hanger 74, allowing landing joint 80 and pipe string 82 to retrieve string hanger 74 and fracturing string 72 from within wellhead assembly 10. In certain embodiments, landing joint 80 has an outer sleeve 86. A lower end of outer sleeve 86 extends over lock ring 76 to disengage lock ring 76 from profile 47 and maintain lock ring 76 in a position that prevents lock ring 76 from moving radially outward as string hanger 74 is removed.

Because the inner radius of the isolation sleeve 50 and the inner radius of the main bore 46 are at least as large as the inner radius of the annular packoff assembly 48, there is sufficient space within the isolation sleeve 50 and tubing head 42 to retrieve the string hanger 74 through tubing head 42. Moreover, the strategically dimensioned isolation sleeve 50 eliminates the steps of adding a bridge plug and blowout preventer before retrieving the string hanger 74 and fracturing string 72 then removing the bridge plug and blowout preventer after retrieving the string hanger 74 and fracturing string 72, as was previously required.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A wellhead assembly comprising:

a casing head mounted on a wellbore;

a tubing head on the casing head;

a main bore extending axially through the casing head and the tubing head;

a landing area in the main bore that is profiled to selectively receive a fracturing string hanger; and an annular isolation sleeve coaxially set in the main bore and having an inner radius greater than an outer radius of the fracturing string hanger, so that the fracturing string hanger selectively passes through the isolation sleeve, wherein the isolation sleeve extends across an interface between the casing head and the tubing head.

2. The wellhead assembly of claim 1, further comprising an annular packoff assembly disposed in the main bore.

3. The wellhead assembly of claim 2, wherein the landing area is along an inner radius of the annular packoff assembly.

4. The wellhead assembly of claim 1, further comprising an annular packoff assembly disposed in the main bore, the annular packoff assembly having: the landing area that is profiled to selectively receive the fracturing string hanger; and a shoulder for mating with the isolation sleeve.

5. The wellhead assembly of claim 1, wherein an inner radius the main bore of the tubing head proximate to the casing head is enlarged to accommodate the isolation sleeve.

6. A wellhead assembly comprising:

a casing head mounted on a wellbore;

a tubing head on the casing head;

a main bore extending axially through the casing head and the tubing head;

an annular packoff assembly disposed in the main bore, the annular packoff assembly having a landing area that is profiled to selectively receive a fracturing string hanger;

an annular isolation sleeve coaxially set in the main bore, a first portion of the isolation sleeve being located in the tubing head and a second portion of the isolation sleeve being located in the casing head, the isolation sleeve having an inner radius greater than an outer radius of the fracturing string hanger, so that the fracturing string hanger selectively passes through the isolation sleeve; and wherein an inner radius of the main bore of the tubing head is greater than an outer radius of the fracturing string hanger, so that the fracturing string hanger selectively passes through the tubing head.

7. The wellhead assembly of claim 6, wherein the annular packoff assembly further comprises a shoulder for mating with the isolation sleeve.

8. The wellhead assembly of claim 6, wherein an inner radius of the main bore of the tubing head is at least as large as an inner radius of the annular packoff assembly.

9. The wellhead assembly of claim 6, wherein the annular packoff assembly further comprises an inner profile for selective engagement with a lock ring of the fracturing string hanger.

10. A method for retrieving a fracturing string hanger from a wellhead assembly, comprising:

(a) installing an annular isolation sleeve and a tubing head on a casing head of a wellbore, the isolation sleeve having an inner radius greater than an outer radius of the fracturing string hanger, and wherein an inner radius of a main bore of the tubing head is greater than an outer radius of the fracturing string hanger;

(b) passing the fracturing string hanger through the isolation sleeve; and (c) retrieving the fracturing string hanger through the tubing head.

11. The method of claim 10, wherein step (a) comprises installing a first portion of the isolation sleeve in the tubing head and installing a second portion of the isolation sleeve in the casing head.

12. The method of claim 10, further comprising before step (a) installing an annular packoff assembly in the casing head, the annular packoff assembly having a landing area that is profiled to selectively receive the fracturing string hanger.

13. The method of claim 12, wherein installing the isolation sleeve on the casing head comprises landing the isolation sleeve on the annular packoff assembly.

* * * * *